US005691739A

United States Patent [19]

Kawamori et al.

[11] Patent Number: 5,691,739

[45] Date of Patent: Nov. 25, 1997

[54] DRIVING DEVICE FOR A LIQUID CRYSTAL DISPLAY WHICH USES COMPENSATING PULSES TO CORRECT FOR IRREGULARITIES IN BRIGHTNESS DUE TO CROSS TALK

[75] Inventors: Hidetsugu Kawamori; Nobuaki Takahashi, both of Nara, Japan

[73] Assignee: Sharp Kabushiki Kaisha, Osaka, Japan

[21] Appl. No.: 363,016

[22] Filed: Dec. 23, 1994

[30] Foreign Application Priority Data

Aug. 2, 1994 [JP] Japan ..... 6-181439

[51] Int. Cl.[6] ..... G09G 3/20

[52] U.S. Cl. ..... 345/58; 345/94; 345/209

[58] Field of Search ..... 345/58, 94, 95, 345/96, 97, 99, 100, 209

[56] References Cited

U.S. PATENT DOCUMENTS

| | | | |
|---|---|---|---|
| 4,485,380 | 11/1984 | Soneda et al. | 345/58 |
| 4,845,482 | 7/1989 | Howard et al. | 345/58 |
| 5,151,690 | 9/1992 | Yamazaki | 345/96 |
| 5,247,376 | 9/1993 | Wakai | 345/210 |
| 5,301,047 | 4/1994 | Hoshino et al. | 345/95 |
| 5,440,322 | 8/1995 | Prince et al. | 345/58 |
| 5,442,370 | 8/1995 | Yamazaki et al. | 345/58 |
| 5,471,228 | 11/1995 | Ilcisin et al. | 345/58 |

FOREIGN PATENT DOCUMENTS

| | | |
|---|---|---|
| 4-348385 | 12/1992 | Japan . |
| 4-360192 | 12/1992 | Japan . |
| 5-100639 | 4/1993 | Japan . |
| 5-127627 | 5/1993 | Japan . |
| 5-210367 | 8/1993 | Japan . |
| 627899 | 2/1994 | Japan . |

*Primary Examiner*—Richard Hjerpe
*Assistant Examiner*—Paul A. Bell

[57] ABSTRACT

A driving device, which drives a display section that consists of a plurality of liquid crystal display elements that are connected to signal lines and scanning lines and that are disposed in the form of matrix, includes a scanning-line driver, a signal-line driver, and a compensating device. The scanning-line driver is for releasing to the scanning lines a scanning signal for selecting the scanning lines successively. The signal-line drive is for releasing to the signal lines a display signal for displaying images in synchronism with the scanning signal. Finally, the compensating device which, during a compensating period that follows a display period during which display signals corresponding to one picture are transmitted to the signal lines, applies to each liquid crystal display element a compensating voltage or compensating pulses that is capable of cancelling a lowering in an effective value of a driving voltage for the liquid crystal display elements during the display period. With this arrangement, since the lowering of the effective value of the driving voltage is cancelled, it becomes possible to display liquid crystal images in high quality.

12 Claims, 13 Drawing Sheets

DISPLAY PERIOD
COMPENSATING PERIOD
13

241
243
1 2 3 · · · · · 239 240
242
254 255 1 2 3
14

16

COMPENSATING PERIOD (t BLANK)
1-FRAME PERIOD(tFRM)
DISPLAY PERIOD
tLP
AC-CONVERSION PERIOD (tFR)
1-LINE COMPENSATING PERIOD(tLPS)
BLANK
LP
FR
"1": EVEN FRAME
"0": ODD FRAME
1-LINE SCANNING PERIOD: tLP=tFR/M
V0
V1
V2
V3
V4
V5
V1 +VS(ODD FRAME)
V1-VS(EVEN FRAME)
+Vop
+Vop/a
-Vop/a
-Vop
VS(ODD FRAME)
VS(EVEN FRAME)

1-FRAME PERIOD
AC-CONVERSION PERIOD

1-LINE SCANNING PERIOD
V0
V1
V2
V3
V4
V5

V0
V1
V2
V3
V4
V5

+Vop

+Vop/a
-Vop/a

-Vop
+Vop

+Vop/a
-Vop/a
-Vop

DRIVING DEVICE FOR A LIQUID CRYSTAL DISPLAY WHICH USES COMPENSATING PULSES TO CORRECT FOR IRREGULARITIES IN BRIGHTNESS DUE TO CROSS TALK

FIELD OF THE INVENTION

The present invention relates to a simple-matrix-type liquid crystal display, and more specifically concerns a driving circuit for use in a liquid crystal display panel.

BACKGROUND OF THE INVENTION

As shown in FIG. 10, when a black pattern with lateral stripes in a white background is displayed on a liquid crystal display panel of the simple-matrix type that is driven by using a voltage-averaging method, crosstalk (the so-called tailing phenomenon) occurs. When some liquid crystal display elements (indicated by black circles in the drawing), which are connected to the scanning lines Y4, Y6, . . . . . , and the signal lines X3, X4, . . . . . , are displayed as black portions, some liquid crystal display elements (indicated by white squares in the drawing), which are connected to these signal lines X3, X4, . . . , and are displayed as white portions, become different in brightness as compared to other liquid crystal display elements (indicated by white circles) that are connected to the other signal lines X1 and X2, and are displayed as white portions.

Crosstalk occurs due to the transient phenomenon that is exerted in the electrostatic capacitance of the liquid crystal display elements. In other words, the effective value of a voltage applied to the liquid crystal display elements of the white circles is supposed to be the same as the effective value of a voltage applied to the liquid crystal display elements of the white squares. However, in an actual operation, they are different from each other due to distortions in the waveforms of the applied voltages that are caused by the transient phenomenon. This causes the difference in brightness.

FIGS. 11(*a*) through 11(*e*) show optimal waveforms of an ac-conversion signal and driving voltages that are respectively applied to the liquid crystal display element of white circle that is connected to the signal line X2 and the scanning line Y2, as well as to the liquid crystal display element of white square that is connected to the signal line X3 and the scanning line Y2.

FIG. 11(*a*) is a waveform of the ac-conversion signal. Here, the driving voltage is subjected to a polarity inversion for each scanning operation corresponding to a predetermined number of lines that is substantially smaller than the number of scanning lines M. Thus, the number of switchovers of the driving voltage is not completely dependent on the display pattern.

The broken line and the solid line of FIG. 11(*b*) show waveforms of driving voltages that are respectively applied to the signal line X2 and the scanning line and the broken line and the solid line of FIG. 11(*c*) show waveforms of driving voltages that are respectively applied to the signal line X3 and the scanning line Y2.

FIG. 11(*d*) shows a waveform of a driving voltage that is applied between the signal line X2 and the scanning line Y2, and FIG. 11(*e*) shows a waveform of a driving voltage that is applied between the signal line X3 and the scanning line Y2.

Since both of the driving voltages of FIGS. 11(*d*) and 11(*e*) are applied to the liquid crystal elements that display the white portions, their effective values are equal to each other. Therefore, the following equation is supposed to hold:

$$\begin{aligned} Von &= ((VOP)^2 + (Vop/a)^2 \times (M-1)/M)^{1/2} \\ &= (Vop/a)\,((a^2 + M - 1)/M)^{1/2}. \end{aligned} \tag{1}$$

Here, Vop is a constant voltage that is predetermined depending on the liquid crystal material. M represents the number of the scanning lines X1 . . . , as described earlier, and M=1/duty ratio holds. Further, A is a bias coefficient. Supposing that the effective value of the driving voltage for the liquid crystal display elements that display the black portions is represented by Voff, a maximum value of Von/Voff is obtained when $a=M^{1/2}+1$.

However, as shown in FIGS. 12(*a*) through 12(*e*), actual waveforms of the driving voltages have distortions. For this reason, in FIGS. 12(*d*) and 12(*e*), the effective values become smaller than Von. Moreover, the waveform of FIG. 12(*e*), which has a more switchovers than that of FIG. 12(*d*), has its effective value further reduced.

In liquid crystal display elements of the negative type wherein on-state elements are displayed as white color, the transmittance commonly becomes higher as the effective voltage increases. Therefore, the transmittance of the liquid crystal display elements indicated by white squares becomes smaller than that of the liquid crystal display elements indicated by white circles. This phenomenon is recognized as the tailing phenomenon.

Similarly, in the case of displaying a white pattern with lateral stripes in the black background, the effective value of the driving voltage for the liquid crystal display elements that display the black portions is supposed to be represented by the following equation in an optimal operation:

$$\begin{aligned} Voff &= ((((1-2a)Vop)^2 + (Vop/a)^2 \times (M-1))/M)^{1/2} \\ &= (Vop/a)\,(((a-2)^2 + M - 1)/M)^{1/2} \end{aligned} \tag{2}$$

However, since an actual waveform of the driving voltage has distortions, the effective value becomes smaller than Voff. Moreover, the effective value becomes smaller as the number of the switchovers in polarity inversion increases. This phenomenon is recognized as the tailing phenomenon.

Next, the following description will discuss a mechanism as to how the waveform distortions occur when the driving voltage for the signal lines changes, with reference to an RC-load model.

Among driving voltages V0 through V5 of six levels to be applied to the signal line Xi and the scanning line Yj, assuming that the driving voltage V1 (or V4), which corresponds to the level of the scanning line Yj in the non-selected state, is the relative ground level (0 V) and that the signal-line Xi is an input terminal, the circuit including the liquid crystal display elements is approximated by an equivalent circuit shown in FIG. 13, which starts from the driver for the signal line Xi and reaches the scanning line Yj through the electrostatic capacitor C of the liquid crystal display elements and the combined resistor R between the electrode resistance of the scanning line Yj and the ON resistance of the driver of the scanning line Yj.

When the power source E of the equivalent circuit is turned on, the voltage across the capacitor C gradually approaches the voltage of the power source E in accordance with the time constant (=RC), as shown in FIG. 14. This is the mechanism by which the waveform distortions are caused.

The amount of lowering in the effective voltage, which is calculated by using the above-mentioned model, is directly proportional to:

$$Vop/a\times(1-(1-1.5C\cdot R\cdot N\cdot F)^{1/2}), \quad (3)$$

where N represents the number of voltage-level inversions in the driving voltage and F represents the inverse number of a frame period, that is, a scanning frequency.

Thus, the lowering in the effective voltage is dependent on the number of voltage-level inversions in the driving voltage. This makes it difficult to completely eliminate irregularities in brightness, such as the tailing phenomenon.

SUMMARY OF THE INVENTION

It is an objective of the present invention to provide a driving device for use in an liquid crystal display that makes it possible to display liquid crystal images in high quality without irregularities in brightness due to crosstalk.

A driving device of the present invention, which drives a display section that includes signal lines, scanning lines, and a plurality of liquid crystal display elements that are connected to the signal lines and the scanning lines and that are disposed in the form of matrix, is provided with: a scanning-line driver for releasing to the scanning lines a scanning signal for selecting the scanning lines successively; a signal-line driver for releasing to the signal lines a display signal for displaying images in synchronism with the scanning signal; and compensating means which, during a compensating period that follows a display period during which display signals corresponding to one picture are transmitted to the signal lines, applies to each liquid crystal display element a compensating voltage that is proportional to the number of polarity inversions during the display period and that is capable of cancelling a lowering in an effective value of a driving voltage for the liquid crystal display elements during the display period. Here, the driving voltage is a difference in voltages between the levels of the display signal and the scanning signal.

With this arrangement, since the lowering of the effective value of the driving voltage is cancelled, it becomes possible to display liquid crystal images in high quality.

Moreover, in order to achieve the above-mentioned objective, another driving device of the present invention is provided with: a scanning-line driver for releasing to the scanning lines a scanning signal for selecting the scanning lines successively; a signal-line driver for releasing to the signal lines a display signal for displaying images in synchronism with the scanning signal; and compensating means which, during a compensating period that follows a display period during which display signals corresponding to one picture are transmitted to the signal lines, applies to each liquid crystal display element compensating pulses the number of which is equal to the number of polarity inversions during the display period and which are capable of cancelling a lowering in an effective value of a driving voltage for the liquid crystal display elements during the display period. Here, the driving voltage is a difference in voltages between the levels of the display signal and the scanning signal.

With this arrangement, the pulse height and pulse width of each compensating pulse are set so that the lowering in the effective value of the driving voltage due to one polarity inversion in the driving voltage coincides with a rise in the effective value of driving voltage that is exerted by the compensating pulse. This makes it possible to eliminate crosstalk completely. Therefore, it becomes possible to display liquid crystal images that have higher quality than the above-mentioned arrangement.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

For a fuller understanding of the nature and advantages of the invention, reference should be made to the ensuing detailed description taken in conjunction with the accompanying drawings.

BRIEF DESCRIPTION OF THE DRAWINGS

FIG. 14 is a graph showing the change in voltage across a capacitor which occurs when the switch of the equivalent circuit of FIG. 13 is turned on.

DESCRIPTION OF THE EMBODIMENTS

Referring to FIGS. 1 through 4, the following description will discuss one embodiment of the present invention.

Figure 1:
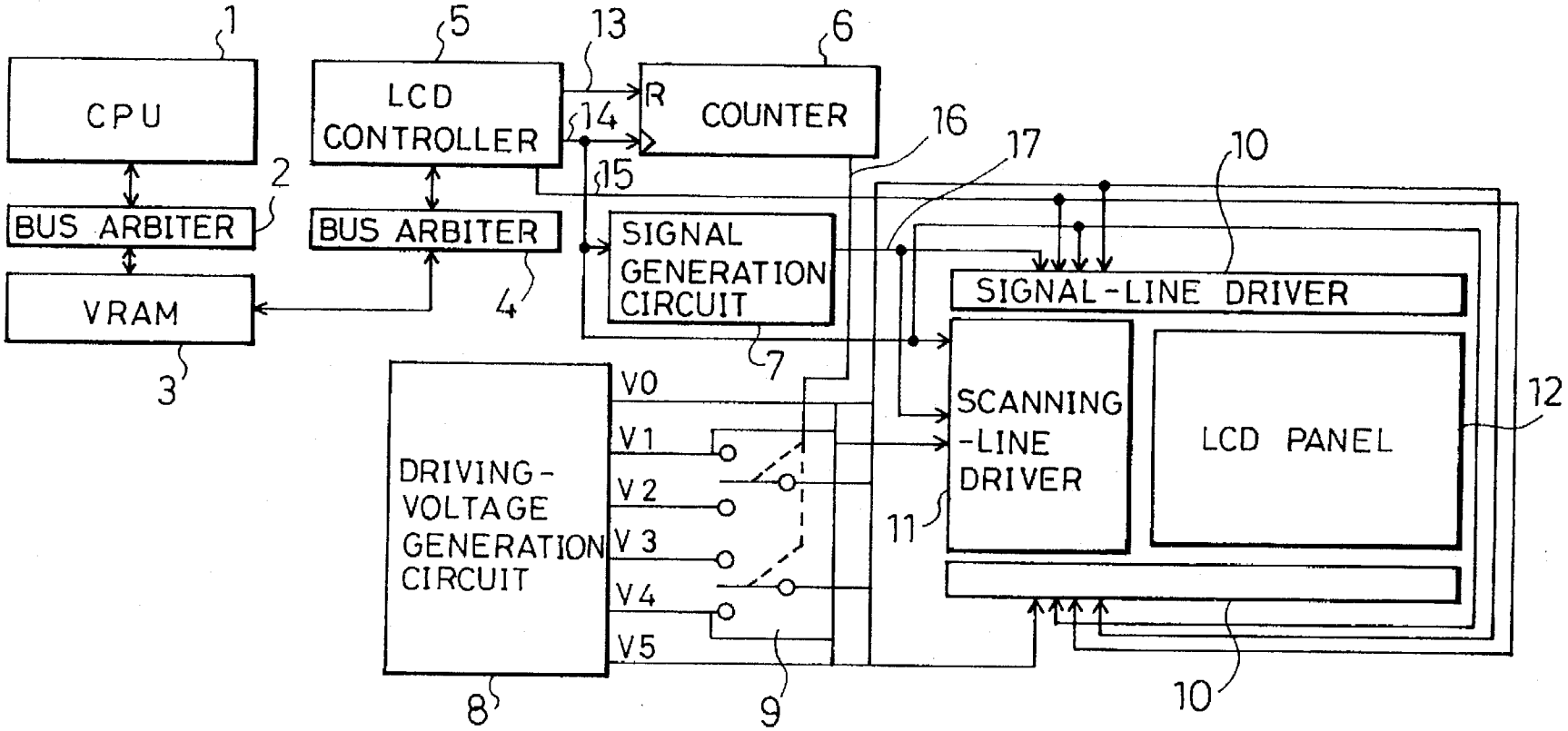
FIG. 1, which shows the first embodiment of the present invention, is a block diagram that shows an essential part of a driving device for liquid crystal display elements.

As illustrated in FIG. 1, a driving device for an LCD (Liquid Crystal Display) of the matrix type of the present invention is provided with: a CPU (Central Processing Unit) 1 for processing data, such as characters, that has been sent from an input device such as a key board (not shown); a VRAM (Video-Use Random Access Memory) 3 for storing display data from the CPU 1; and an LCD controller 5 for providing controlling operations so as to read out the display data stored in the VRAM 3 and display the display data on the LCD panel 12.

Between the CPU 1 and the VRAM 3 as well as between the LCD controller 5 and the VRAM 3, are disposed BUS arbiters 2 and 4 which provide controlling operations so as not to allow the CPU 1 and the LCD controller 5 to access the VRAM 3 at the same time.

The driving device for the LCD of the present embodiment is further provided with: a counter 6; a signal generation circuit 7 for use in ac-conversion; a driving-voltage generation circuit 8 for generating voltages of six different levels that drive the LCD panel 12; a switch section 9 for switching the driving voltages from the driving-voltage generation circuit 8; two signal-line drivers 10 for driving signal electrodes (row electrodes) of the LCD panel 12; and a scanning-line driver 11 for driving scanning electrodes of the LCD panel 12.

The LCD controller 5 releases a frame signal 13 and a clock signal 14, as well as releasing display data read out from the VRAM 3, as a data signal 15. The frame signal 13, released from the LCD controller 5, is inputted to the reset terminal (R) of the counter 6. The clock signal 14, released from the LCD controller 5, is inputted to the clock terminal (>) of the counter 6, the signal generation circuit 7, the drivers 10, and the driver 11.

The counter 6 releases a display-period signal 16 to the switch section 9 in accordance with the frame signal 13 and the clock signal 14. The signal generation circuit 7 releases an ac-conversion signal 17 to the drivers 10 and 11 in accordance with the clock signal 14.

In the above-mentioned arrangement in the driving device for liquid crystal display elements of the present embodiment, after the display data of one frame has been displayed on the LCD panel 12, a compensating voltage is applied from the drivers 10 to the signal electrodes of the LCD panel 12 in order to cancel a drop or a rise that has occurred in the effective voltage during the display period. Here, supposing that the period during which the compensating voltage is applied is referred to as a compensating period, the 1-frame period of the present embodiment corresponds to a period that is made by adding the display period (=M×1-clock period) and the compensating period (=X×1-clock period). Here, X is set to an appropriate integral number for compensation.

For example, supposing that a compensating voltage of (Vop/a) V is applied for a period of L×1 clock during the compensating period, the following equations hold:

$$Von=Vop/a\times((a^2+M-1-G+L)/(M+X))^{1/2}, \quad (4)$$

$$Voff=Vop/a\times(((a-2)^2+M-1-G+L)/(M+X))^{1/2}, \quad (5)$$

$$\text{and } G=6C\cdot R\cdot N\cdot(M+X)\cdot F, \quad (6)$$

where C and R respectively represent the capacitance and the loop resistance of the liquid crystal display elements, N represents the number of switchovers in the voltage levels of the signal voltage, and F represents the inverse number of a frame period, that is, a scanning frequency.

Therefore, if the number of compensations L is set so as to satisfy L=G, G, which is dependent on N, is cancelled. Thus, it becomes possible to eliminate irregularities in brightness, such as shadowing and tailing.

Figures 2A, 2B, 2C, 2D, 2E, 2F:
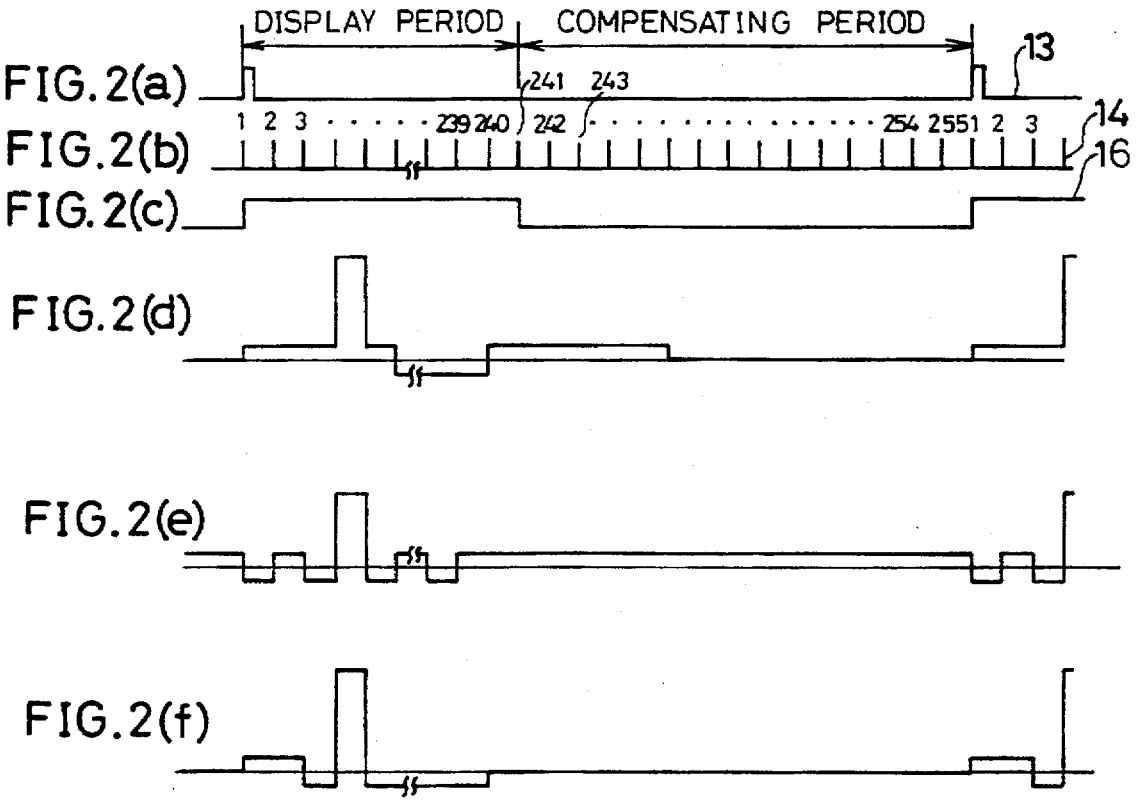
FIGS. 2(*a*) through 2(*f*) show waveforms that indicate the operations of the driving device for liquid crystal display elements of FIG. 1.

For example, referring to FIG. 2, the following description will discuss a case where a LCD panel 12 with 640×480 dots is driven.

As shown in FIG. 2(*a*), the frame signal 13 consists of pulses, each of which is released for each frame. Further, as shown in FIG. 2(*b*), the clock signal 14 consists of pulses, each of which is released for each clock.

Supposing that M=240 and X=15, the 1-frame period is equal to 255×1-clock period. As shown in FIG. 2(*c*), the display-period signal 16 goes high during a 240×1-clock period that corresponds to the leading part of the 1-frame period, and then goes low during a 15×1-clock period that corresponds to the following part of the 1-frame period. The aforementioned display period coincides with the high-level period in the display-period signal 16, and during this period, the display data is displayed on the LCD panel 12. The aforementioned compensating period, on the other hand, coincides with the low-level period in the display-period signal 16, and during this period, the compensating voltage is applied.

For example, supposing that F=60 Hz and CR=0.5 μs, M=0.046 N is obtained from the above-mentioned equation. Here, since 0.046×20=0.92 ≈1 holds, the compensating voltage is applied for the 1-clock period, every time 20 switchovers have been virtually completed between the on-state voltage and the off-state voltage.

Figure 3:
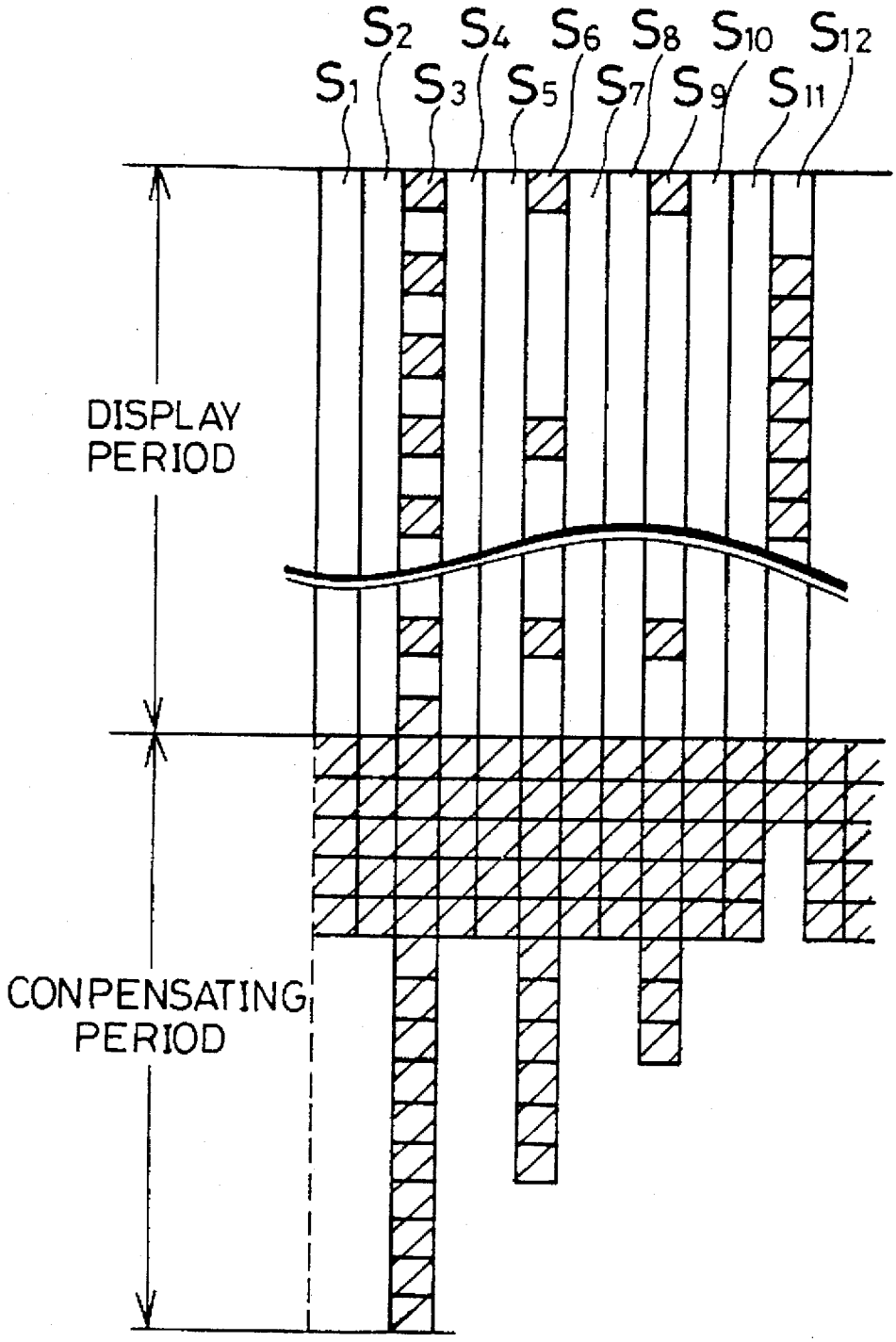
FIG. 3 is an explanatory drawing that relates to the waveforms shown in FIGS. 2(*d*) through 2(*f*).

FIG. 3 shows one example of time-based changes in signal voltages that are applied to signal electrodes $S_1$, $S_2$, $S_3$ . . . . , and so on.

In the drawing, during the display period, portions indicated by hatching represent periods during which the on-state voltage (V0 or V5 in the voltage level) is applied, and void portions represent periods during which the off-state voltage (V2 or V3 in the voltage level) is applied.

During the compensating period, portions indicated by hatching represent periods during which a compensating voltage equivalent to the on-state voltage (V0 or V5 in the voltage level) is applied in the same manner as the display period, and void portions represent periods during which a compensating voltage equivalent to the non-selection voltage (V1 or V4 in the voltage level) is applied.

As described above, in the present embodiment, depending on whether a void portion in question corresponds to the display period or the compensating period, the voltage level to be applied to the period of the void portion in question is switched. The switchover in the voltage levels is carried out by the switch section 9. In other words, by controlling the switch section 9 by the use of the display-period signal 16, the voltage level to be applied from the driving-voltage generation circuit 8 to the drivers 10 is switched.

In the signal electrodes $S_1$, $S_2$, $S_4$, $S_5$, $S_7$, $S_8$ . . . . , and so on, the number of switchovers between the on-state voltage and the off-state voltage is set to be a standard value, and as shown in FIG. 2(*d*), if the compensating voltage is applied for a 5-clock period corresponding to L=5, the term including G will be cancelled.

In the signal electrode $S_3$, the switchovers between the on-state voltage and the off-state voltage occur alternately, resulting in an increased number of switchovers. Since this makes G greater, it is necessary to make L greater than the above-mentioned value. Therefore, for example, as shown in FIG. 2(*e*), if L=15 is set, the term including G will be cancelled.

In the signal electrode $S_{12}$, the period during which the on-state voltage is applied is comparatively long, resulting in a reduced number of switchovers. Since this makes G smaller, it is necessary to make L smaller than the above-mentioned value. Therefore, for example, as shown in FIG. 2(*f*), if L=2 is set, the term including G will be cancelled.

The value of L is determined by the LCD controller 5, and the value is sent to the drivers 10 as the data signal 15, during the compensating period that is indicated by the display-period signal 16.

Figure 4:
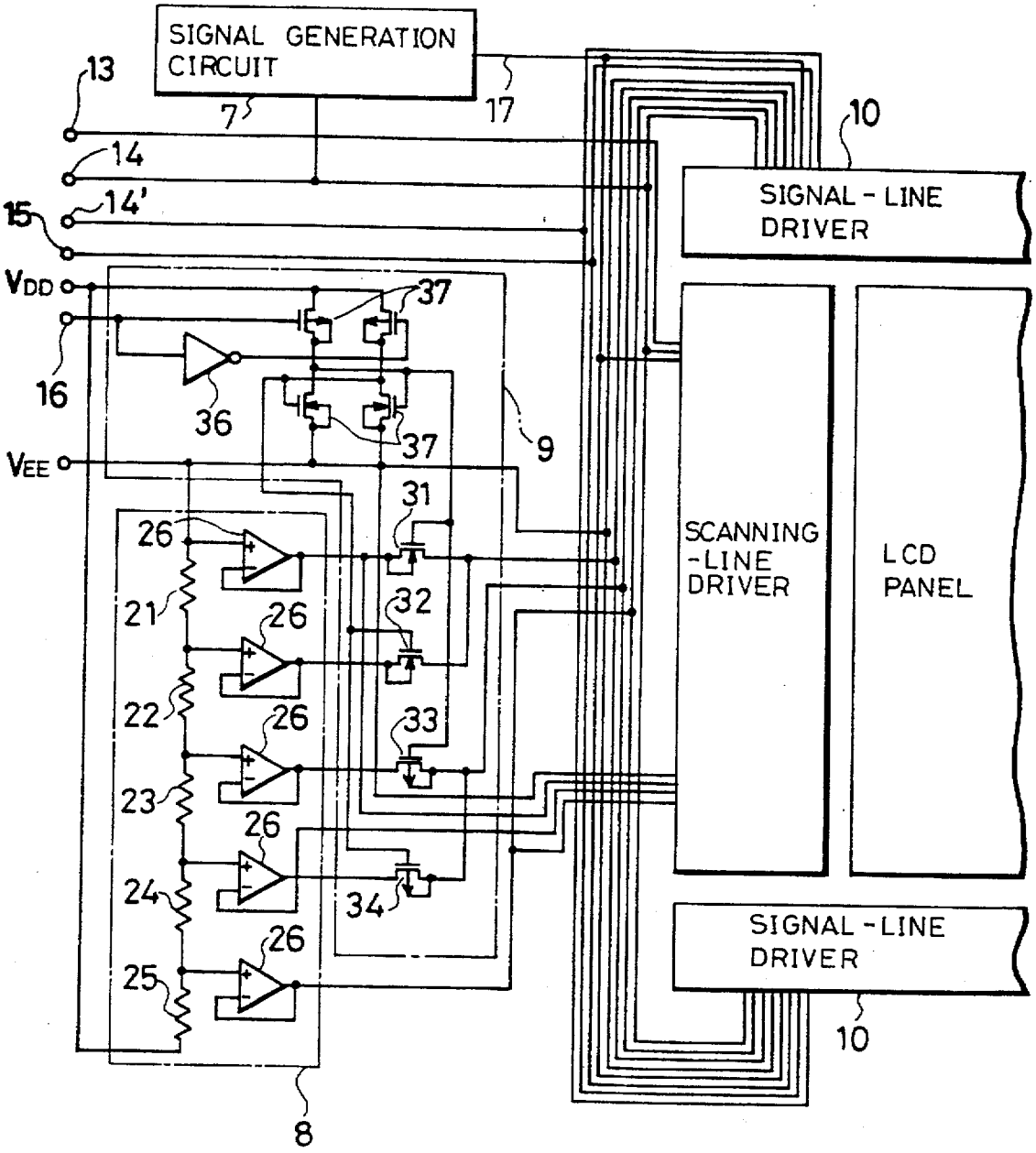
FIG. 4 is a circuit diagram showing a specific example of the driving device for liquid crystal display elements of FIG. 1.

FIG. 4 shows a specific example of the driving-voltage generation circuit 8 and the switch section 9 that are used in the driving device for liquid crystal display elements.

The driving-voltage generation circuit 8 is constituted of five resistors 21 through 25 and five operational amplifiers 26. The resistors 21 through 25 are connected in series with one another, and the voltage $V_{DD}$ and the voltage $V_{EE}$ from the power source are applied to the respective sides of these resistors 21 through 25. Voltages, divided by the resistors 21 through 25, are respectively inputted to the operational amplifiers 26, and voltage levels, V1 through V5, are released from the operational amplifiers 26. Additionally, the voltage level V0 is directly obtained from the voltage $V_{EE}$ from the power source.

The switch section 9 is constituted of a flipflop consisting of an inverter 36 and four FETs (Field Effect Transistor) 37, and four switches consisting of FETs 31 through 34. The voltage levels of V1 through V4, released from the driving-voltage generation circuit 8, are respectively inputted to the sources of the FET 31 through 34, and their drains are connected to the drivers 10.

In the above-mentioned arrangement, either the FET 31 or the PET 33 turns on depending on the levels of the display-period signal 16. Thus, either the voltage level V1 or the voltage level V3 from the driving-voltage generation circuit 8 is selected, and is inputted to the drivers 10. Similarly, either the FET 32 or the FET 34 turns on depending on the levels of the display-period signal 16. Thus, either the voltage level V4 or V2 from the driving-voltage generation circuit 8 is selected, and is inputted to the drivers 10.

Additionally, a clock signal 14', shown in the drawing, is obtained by inverting the clock signal 14.

Figure 5:
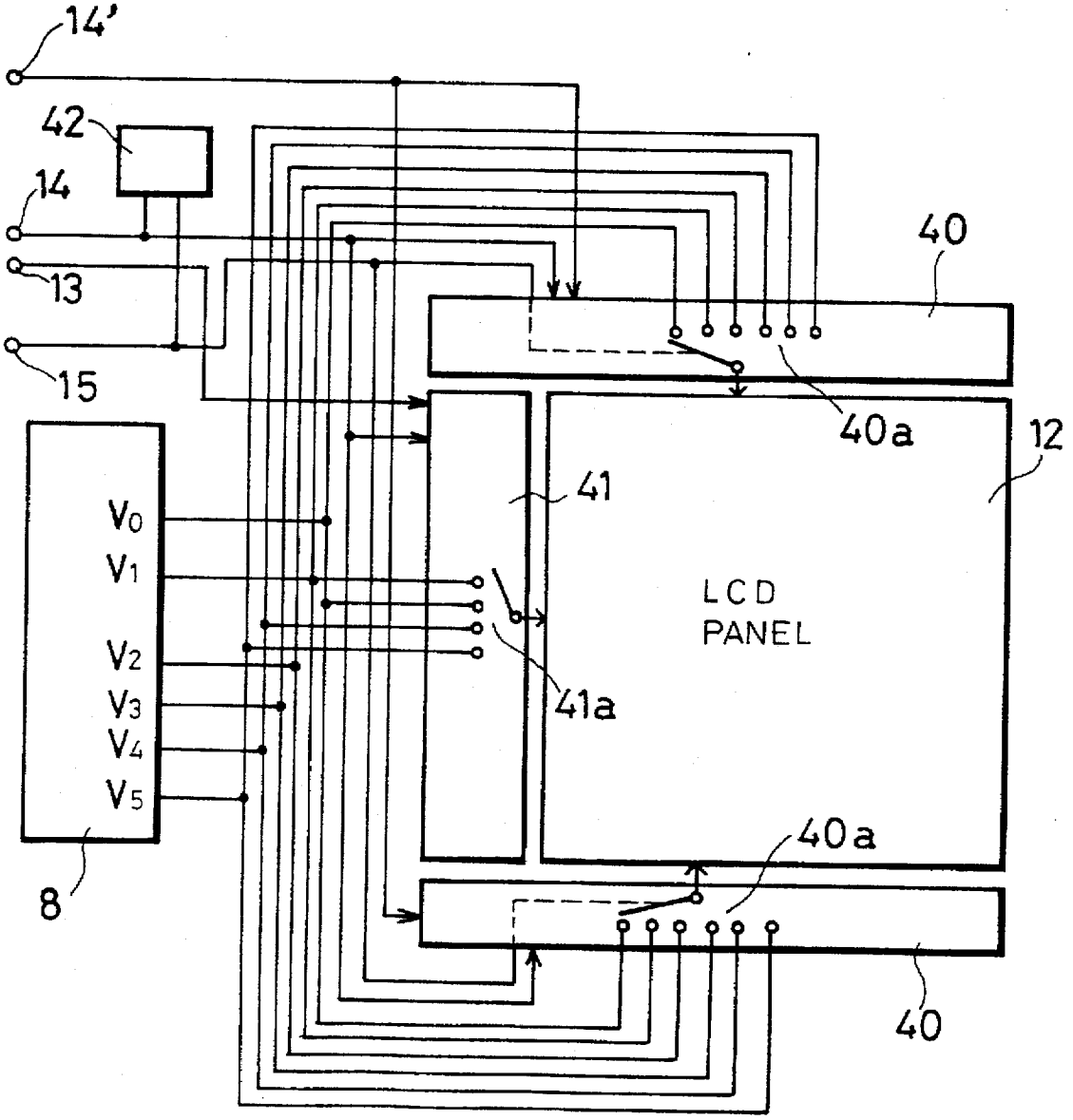
FIG. 5, which shows the second embodiment of the present invention, is a block diagram that shows an essential part of a driving device for liquid crystal display elements.

Referring to FIG. 5, the following description will discuss the second embodiment of the present invention. Here, for convenience of explanation, those members that have the same functions and that are described by reference to the drawings of the aforementioned embodiment are indicated by the same reference numerals and the description thereof is omitted.

As illustrated in FIG. 5, a driving device for an LCD of the matrix type of the present embodiment is provided with an L-generation circuit 42 for determining the value of L in accordance with the data signal 15 and the clock signal 14. As for the switchovers between the voltage levels, V0 through V5, during the display period and the compensating period, the operations are carried out by a switch section 40*a* that is installed in the drivers 40 for signal electrodes. As for the switchovers between the scanning voltage levels V1 and V4, the operations are carried out by a switch section 41*a* that is installed in the driver 41 for scanning electrodes, as have been carried out conventionally. The display-period signal 16 is generated in the LCD controller 5.

As described above, the driving device for liquid crystal display elements of the present embodiment is made by simply adding the L-generation circuit 42 to a conventional driving device for liquid crystal display elements. Therefore, it is possible to eliminate irregularities in brightness, such as shadowing, easily without modifying the construction of the apparatus to a great degree.

Referring to FIGS. 6 through 9, the following description will discuss the third embodiment of the present invention. Here, for convenience of explanation, those members that have the same functions as the members that have been described in the aforementioned embodiments with reference to their drawings are indicated by the same reference numerals and the description thereof is omitted.

Figure 6:
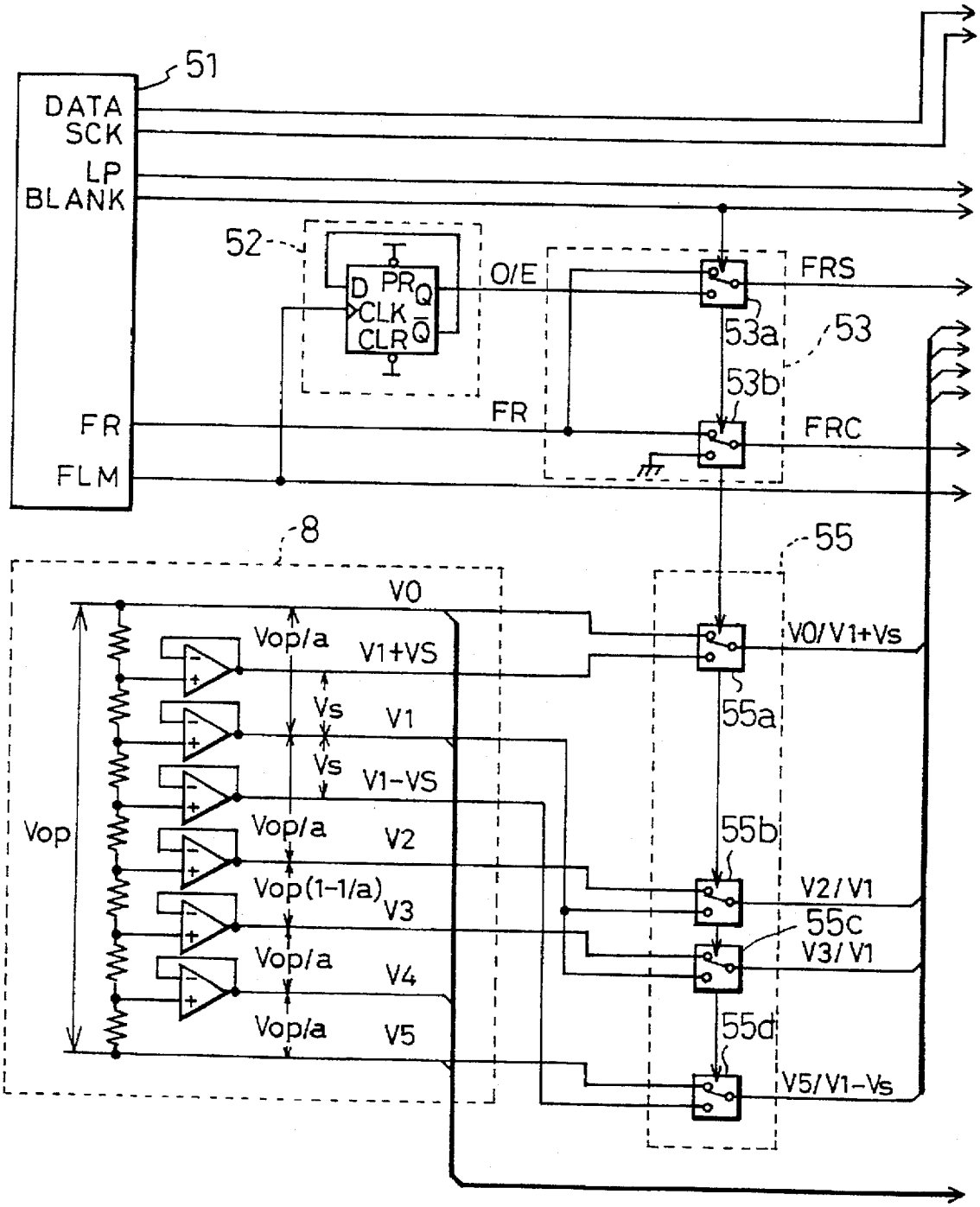
FIG. 6, which shows the third embodiment of the present invention, is a schematic block diagram that partially shows a liquid crystal display.

As illustrated in FIG. 6, the liquid crystal display of the present embodiment is provided with a signal generation circuit 51 for generating display data (DATA) and various timing signals, a frame-discriminating circuit 52, a signal-switching circuit 53, a driving-voltage generation circuit 8 for generating driving voltages for a LCD panel 12, and a power-source switching circuit 55.

Figure 7:
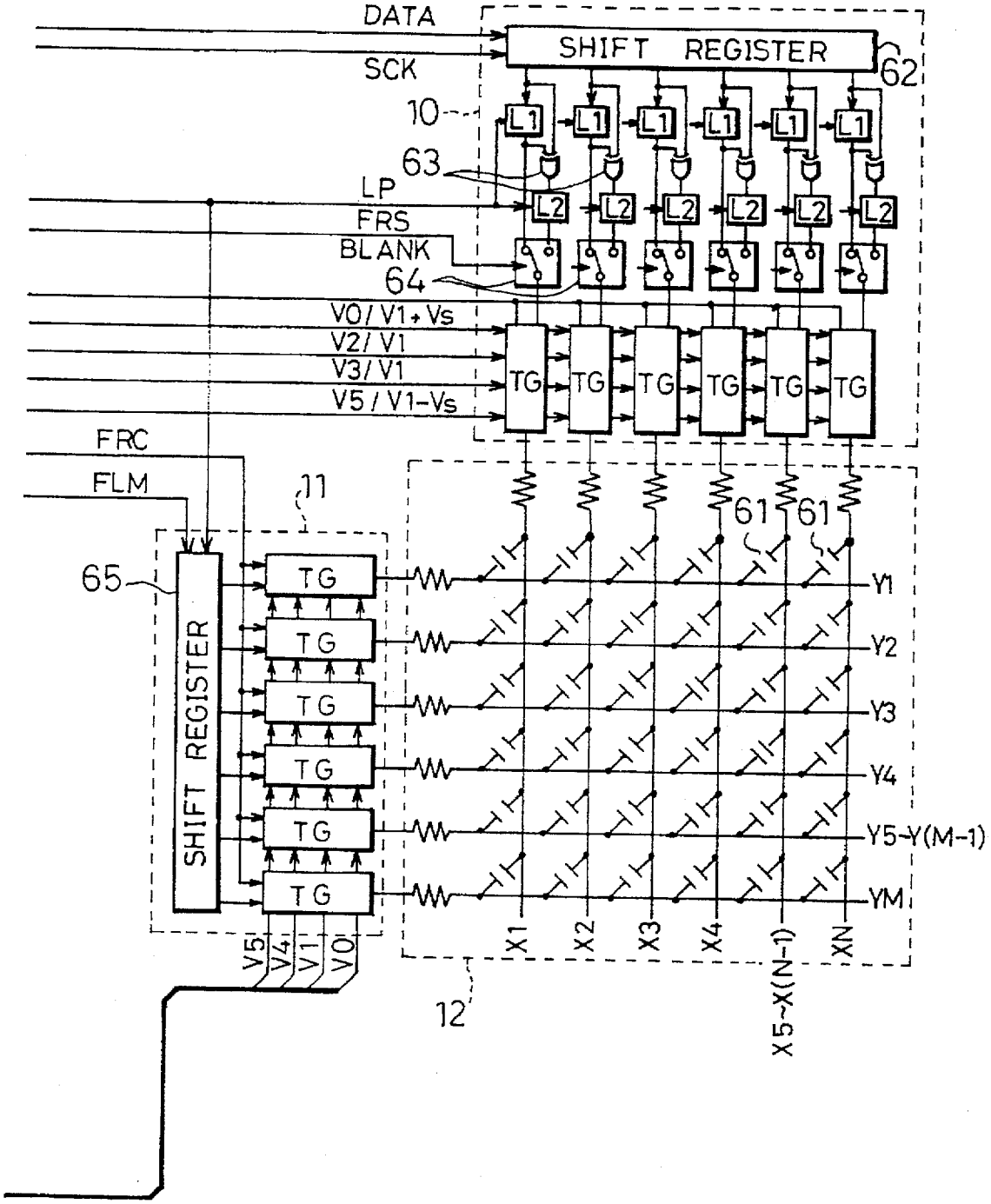
FIG. 7 is a schematic partial block diagram of the liquid crystal display, which is connected to FIG. 6.

As illustrated in FIG. 7, the liquid crystal display of the present embodiment is further provided with the LCD panel 12 of the simple-matrix type, a signal-line driver 10 for driving signal lines, X1, X2, . . . XN, and so on, of the LCD panel 12, and a scanning-line driver 11 for driving scanning lines, Y1, Y2, . . . . YN, and so on, of the LCD panel 12.

The signal generation circuit 51 releases a scanning clock LP and a scanning-start signal FLM corresponding to one frame, as well as releasing display data in synchronism with a shift clock SCK. Moreover, the signal generation circuit 51 further releases a control signal BLANK that indicates whether a period in question corresponds to the display period or the compensating period and an ac-conversion signal FR for inverting the driving voltage for each display period corresponding to several lines.

The frame-discrimination circuit 52, which is constituted of a flipflop, releases a frame-discrimination signal O/E that indicates whether a frame in question is an odd-numbered frame or an even-numbered frame in accordance with the scanning-start signal FLM.

The signal-switching circuit 53 consists of two switching circuits 53*a* and 53*b*. The switching circuit 53*a* selects the ac-conversion signal FR or the frame-discrimination signal O/E in accordance with the control signal BLANK, and releases the resulting signal as a signal FRS, while the switching circuit 53*b* selects the ac-conversion signal FR or a Low-Level signal in accordance with the control signal BLANK, and releases the resulting signal as a signal FRC.

The driving-voltage generation circuit 8, which is constituted of resistors and buffers for dividing the voltage Vop, releases voltages of six levels, V0 through V5, for driving the liquid crystal display panel 12, as well as releasing voltages of two levels, (V1±Vs) for compensating for the driving voltage. Here, the values of the resistors are set so as to satisfy the following equations and inequality:

$$V0-V5=Vop, \tag{7}$$

$$V0-V1=V1-V2=V3-V4=V4-V5, \tag{8}$$

and $$0<Vs<V0-V1. \tag{9}$$

Here, the setting value of the voltage Vs will be described later.

The power-source switching circuit 55 consists of four switching circuits 55*a* through 55*d*. The switching circuit 55*a* selects V0 or V1+Vs in accordance with the control signal BLANK, and releases the resulting voltage; the switching circuit 55*b* selects V2 or V1, and releases the resulting voltage; the switching circuit 55*c* selects V3 or V1, and releases the resulting voltage; and the switching circuit 55*d* selects V5 or V1−Vs, and releases the resulting voltage.

The LCD panel 12 is provided with N×M number of liquid crystal display elements 61, which are connected between the respective signal lines Xi and scanning lines Yj, and which are disposed in the form of matrix.

The signal-line driver 10 is constituted of: a shift register 62 for storing display data that is successively transferred from the signal-generation circuit 51 by an amount corresponding one line in synchronism with the shift clock SCK; the first latch circuits L1 for holding the data from the shift register 62, and for releasing the data in synchronism with the scanning clock LP; exclusive OR circuits 63 for discriminating whether or not the data released from the sift register 62 is identical to the data released from the first latch circuit L1; the second latch circuits L2 for holding the results of the discrimination of the exclusive OR circuits 63, and for releasing the results in synchronism with the scanning clock LP; selector circuits 64 for selecting the data from the first latch circuits L1 or the data from the second latch circuits L2 in accordance with the control signal BLANK; and transmission gates TGs for selecting voltages from the power-source switching circuits 55 in accordance with the outputs of the selector circuits 64 and the signal FRS, and for releasing the resulting signals to the signal lines, X1, X2 . . . , and so on.

The scanning-line driver 11 is constituted of: a shift register 65 for shifting the scanning-start signal FLM released from the signal-generation circuit 51 in synchronism with the scanning clock LP; and transmission gates TGs that make selections from the voltages released from the driving-voltage generation circuit 8 in accordance with the output of the shift register 65 and the signal FRC and release the resulting voltages to the scanning line Y1, Y2, . . . , and so on.

The first latch circuits L1 and the exclusive OR circuits 63 of the signal-line driver 10 constitute a discrimination device of the present invention. Moreover, the driving-voltage generation circuit 8, the power-source switching circuit 55, the transmission gates TGs of the signal-line driver 10, and the transmission gates TGs of the scanning-line driver 11 constitute an applying device in the present invention.

Figures 8A, 8B, 8C, 8D, 8E, 8F, 8G:
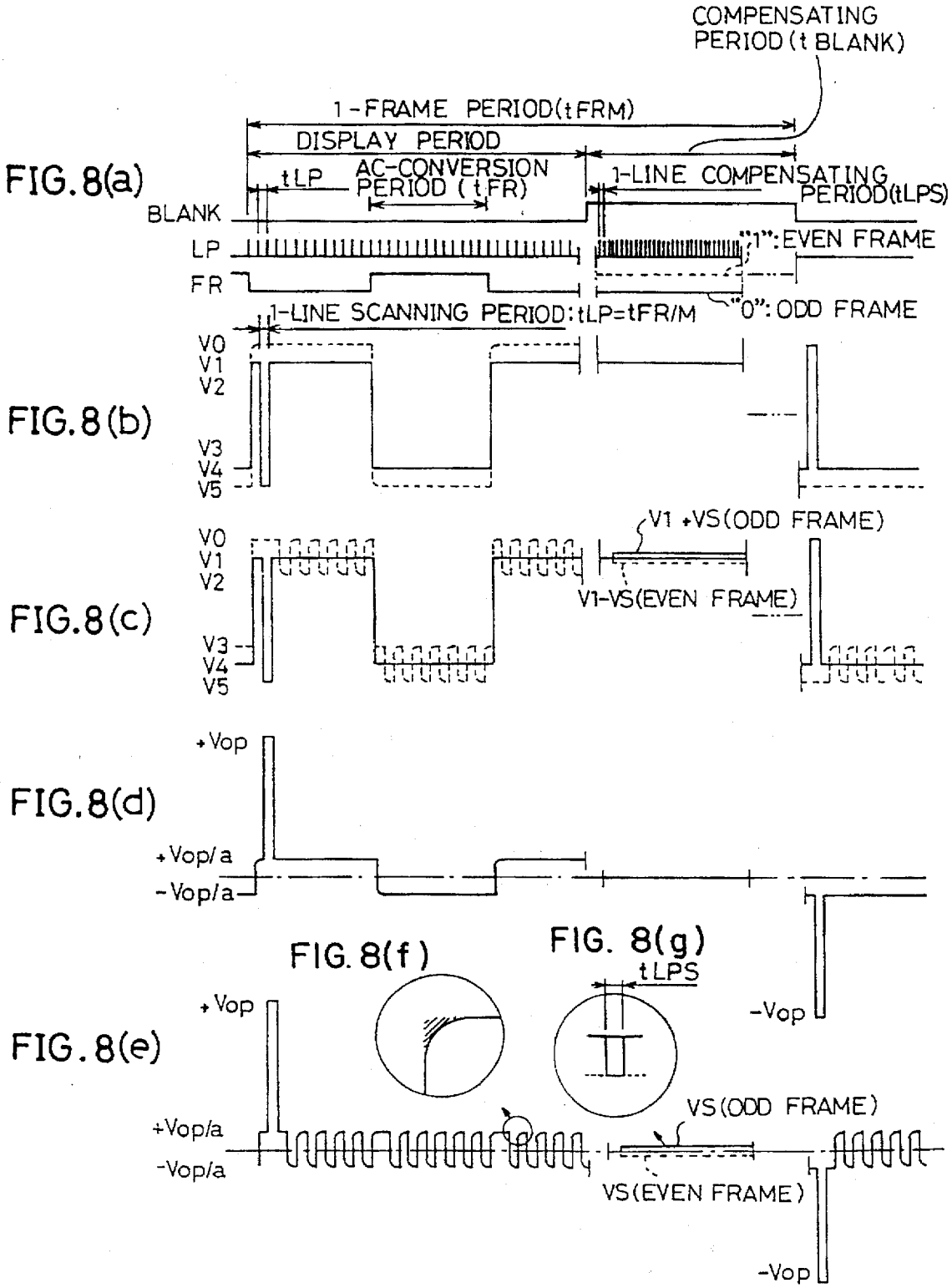
FIG. 8(*a*) through FIG. 8(*g*) show waveforms that indicate the operations of the liquid crystal display shown in FIG. 6 and FIG. 7.

In the above-mentioned arrangement, as shown in FIG. 8(*a*), the control signal BLANK, released from the signal generation circuit 51, goes low during a display period, and goes high during a compensating period (tBLANK) that follows the display period. Here, the 1-frame period (tFRM) of the present embodiment is a period that is made by adding the display period and the compensating period.

The scanning clock LP goes high for each 1-line scanning period (tLP) during the display period, and goes high for each 1-line compensating period (tLPS) during the compensating period. The ac-conversion signal FR goes high for each predetermined ac-conversion period (tFR).

The signal generation circuit 51 successively transfers display data corresponding to one picture to the signal-line driver 10 during the display period in synchronism with the shift clock SCK, and then successively transfers the same display data corresponding to one picture to the signal-line driver 10 again in synchronism with the shift clock SCK during the compensating period.

The frame-discrimination circuit 52 releases a frame-discrimination signal O/E in accordance with the scanning-start signal FLM released from the signal generation circuit 51. The frame-discrimination signal O/E goes low upon receipt of an odd-numbered frame, and goes high upon receipt of an even-numbered frame.

The switching circuit 53*a* of the signal-switching circuit 53 selects the ac-conversion signal FR or the frame-discrimination signal O/E in accordance with the control signal BLANK released from the signal generation circuit 51, and releases the resulting signal as a signal FRS. In other words, as shown in Table 1, the switching circuit 53*a* releases the ac-conversion signal FR when the control signal BLANK is low (that is, during the display period), and releases the frame-discrimination signal O/E when it is high (that is, during the compensating period). Here, in the following Table 1, "0" represents the low level, and "1" represents the high level.

TABLE 1

| BLANK | FRS | FRC |
|---|---|---|
| 0 | FR | FR |
| 1 | O/E | 0 |

The switching circuit 53*b* of the signal-switching circuit 53 selects the ac-conversion signal FR or the low-level signal (a signal in the ground level) in accordance with the control signal BLANK released from the signal generation circuit 51, and releases the resulting signal as a signal FRS. In other words, as shown in Table 1, the switching circuit 53*b* releases the ac-conversion signal FR when the control signal BLANK is low, and releases the low-level signal when it is high.

The switching circuit 55*a* of the power-source switching circuit 55 selects V0 or V1+Vs released from the driving-voltage generation circuit 8 in accordance with the control signal BLANK, and releases the resulting voltage. In other words, as shown in Table 2, the switching circuit 55*a* releases the voltage V0 when the control signal BLANK is low, and releases the voltage V1+Vs when it is high.

TABLE 2

| BLANK | V0/V1 + Vs | V2/V1 | V3/V1 | V5/V1 − Vs |
|---|---|---|---|---|
| 0 | V0 | V2 | V3 | V5 |
| 1 | V1 + Vs | V1 | V1 | V1 − Vs |

Similarly, the switching circuits 55*b* through 55*d* of the power-source switching circuit 55 make selections from the voltages shown in Table 2 in accordance with the control signal BLANK, and release the resulting voltages.

The shift register 62 of the signal-line driver 10 stores display data that is successively transferred from the signal generation circuit 51 by an amount corresponding to one line in synchronism with the shift clock SCK. The first latch circuits L1 hold the data from the shift register 62, and release the data in synchronism with the scanning clock LP. The exclusive OR circuits 63 release signals in the high level when the data from the shift register 62 is identical to the data from the first latch circuits L1. The second latch circuits L2 hold the outputs from the exclusive OR circuits 63, and release the outputs in synchronism with the scanning clock LP.

The selector circuits 64 select the data from the first latch circuits L1 or the data from the second latch circuits L2 in accordance with the control signal BLANK, and release the resulting data. In other words, the selector circuits 64 release the data from the first latch circuits L1 when the control signal BLANK is low, and release the data from the second latch circuits L2 when it is high.

The transmission gates TGs make selections from the voltages from the power-source switching circuit 55 in accordance with the signal FRS from the switching circuit 53*a* of the signal-switching circuit 53 and the data from the selector circuits 64, and release the resulting voltages to the signal lines X1, X2 . . . , and so on of the LCD panel 12.

In other words, as shown in Table 3, in the case of the low level of the control signal BLANK (that is, during the display period), the transmission gates TGs release the voltage V2 or V0 when the ac-conversion signal FR is low, and release the voltage V3 or V5 when the ac-conversion signal FR is high, in accordance with the display data corresponding to one picture released from the signal generation circuit 51.

On the other hand, in the case of the high level of the control signal BLANK (that is, during the compensating period), the transmission gates TGs release either of the voltages, V1, V1+Vs, and V1−Vs in accordance with the outputs of the exclusive OR circuits 63. In other words, they release the voltage V1 in the case of outputting the data that is the same as that outputted one line earlier to the signal line Xi. In the case of outputting different data, they release the voltage V1+Vs upon receipt of an odd-numbered frame, and release the voltage V1−Vs upon receipt of an even-numbered frame.

TABLE 3

| BLANK | O/E | FR | DATA | XN |
|---|---|---|---|---|
| 0 | — | 0 | 0 | V2 |
| | | 1 | 0 | V3 |
| | | 0 | 1 | V0 |
| | | 1 | 1 | V5 |
| 1 | — | — | 0 −> 0<br>1 −> 1 | V1 |
| | 0 | | 0 −> 1<br>1 −> 0 | V1 + Vs |
| | 1 | | 0 −> 1<br>1 −> 0 | V1 − Vs |

The shift register 65 of the scanning-line driver 11 shifts the scanning-start signal FLM released from the signal generation circuit 51 in synchronism with the scanning clock LP, and successively releases the resulting signal to the transmission gates TGs. The transmission gates TGs make selections from the voltages released from the driving-voltage generation circuit 8 and release the resulting voltages to the scanning lines Y1, Y2 . . . , and so on of the LCD panel 12, in accordance with the signal FRC from the switching circuit 53*b* of the signal-switching circuit 53 and the output from the shift register 65.

More specifically, as shown in Table. 4, in the case of the low level of the control signal BLANK (that is, during the display period), the transmission gates TGs release the voltage V1 or V5 when the ac-conversion signal FR is low, and release the voltage V0 or V4 when the ac-conversion signal FR is high, in accordance with the output from the shift register 62.

In the case of the high level of the control signal BLANK (that is, during the compensating period), the transmission gates TGs always release the voltage V1.

TABLE 4

| BLANK | FR | FLM | YM |
|---|---|---|---|
| 0 | 0 | 0 | V1 |
| | 1 | 0 | V4 |
| | 0 | 1 | V5 |
| | 1 | 1 | V0 |
| 1 | — | — | V1 |

As described above, in the liquid crystal display of the present embodiment, during the display period, the signal lines X1, X2 . . . and the scanning lines Y1, Y2 . . . are driven by using the voltages V0 through V5 of the six levels, in the same manner as conventional arrangements.

In contrast, during the compensating period, the signal lines X1, X2 . . . are driven by using the voltages of the three levels, V1, V1+Vs, and V1−Vs, and the scanning lines Y1, Y2 . . . are driven by using the voltage V1 of the one level.

Therefore, during the compensating period, no voltage is applied to the liquid crystal display elements 61 in the case of releasing the data that is the same as that one line earlier to the signal line Xi. In the case of outputting data different from the data one line earlier to the signal line Xi, the transmission gates TGs release the voltage +Vs upon receipt of an odd-numbered frame, and release the voltage −Vs upon receipt of an even-numbered frame. In other words, every time the polarity inversion takes place in the driving voltage of the liquid crystal display elements 61, the voltage +Vs or −Vs is applied during 1-line compensating period.

Figure 9:
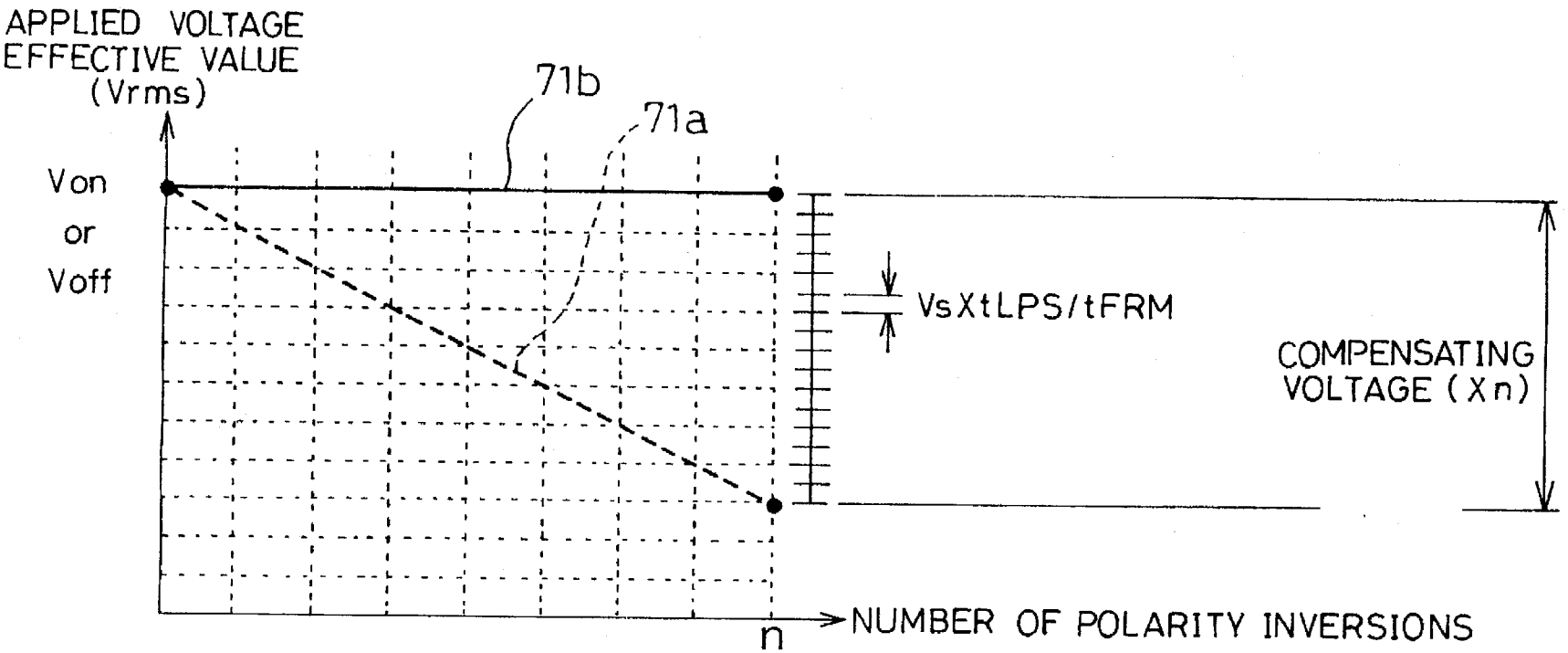
FIG. 9 is an explanatory drawing that indicates a compensating voltage to be applied to liquid crystal display elements in the liquid crystal display shown in FIG. 6 and FIG. 7.

As shown in FIG. 9, when the voltage +Vs is applied during the 1-line compensating period (tLPS), the effective voltage Vrms in the 1-frame period (tFRM) rises by an amount of Vs×tLPS/tFRM. Here, as explained in the prior art description, the effective voltage Vrms falls in proportion to the number of the polarity inversions in the driving voltage of the liquid crystal display elements 61 as is indicated by the straight line 71*a*, due to the RC components of the liquid crystal display elements 61.

In order to solve this problem, the present embodiment sets Vs and tLPS so that the reduced amount of the effective voltage Vrms that is caused by one polarity inversion due to the RC components of the liquid crystal display elements 61 is equal to the increased amount of the effective voltage Vrms that is obtained by applying the voltage +Vs during the 1-line compensating period, that is, Vs×tLPS/tFRM. With this arrangement, it is possible to completely cancel the lowering of the effective voltage Vrms caused by the RC components of the liquid crystal display elements 61.

As a result, the effective voltage Vrms is kept at Von or Voff independent of the number of the polarity inversions, as is indicated by the straight line 71*b*. Thus, it becomes possible to eliminate crosstalk completely. (Here, in the present invention, the pulse having a wave-height value of Vs and a width of tLPS is referred to as a compensating pulse.)

Further, the liquid crystal display of the present embodiment eliminates the necessity of having to install a complicated operational circuit for finding the number of applications of a compensating voltage that corresponds to the number of the polarity inversions in the driving voltage of the liquid crystal display elements 61. This makes it possible to extremely simplify the apparatus construction compared to conventional apparatuses, thereby achieving a liquid crystal display with virtually no crosstalk at lower costs.

Figure 10:
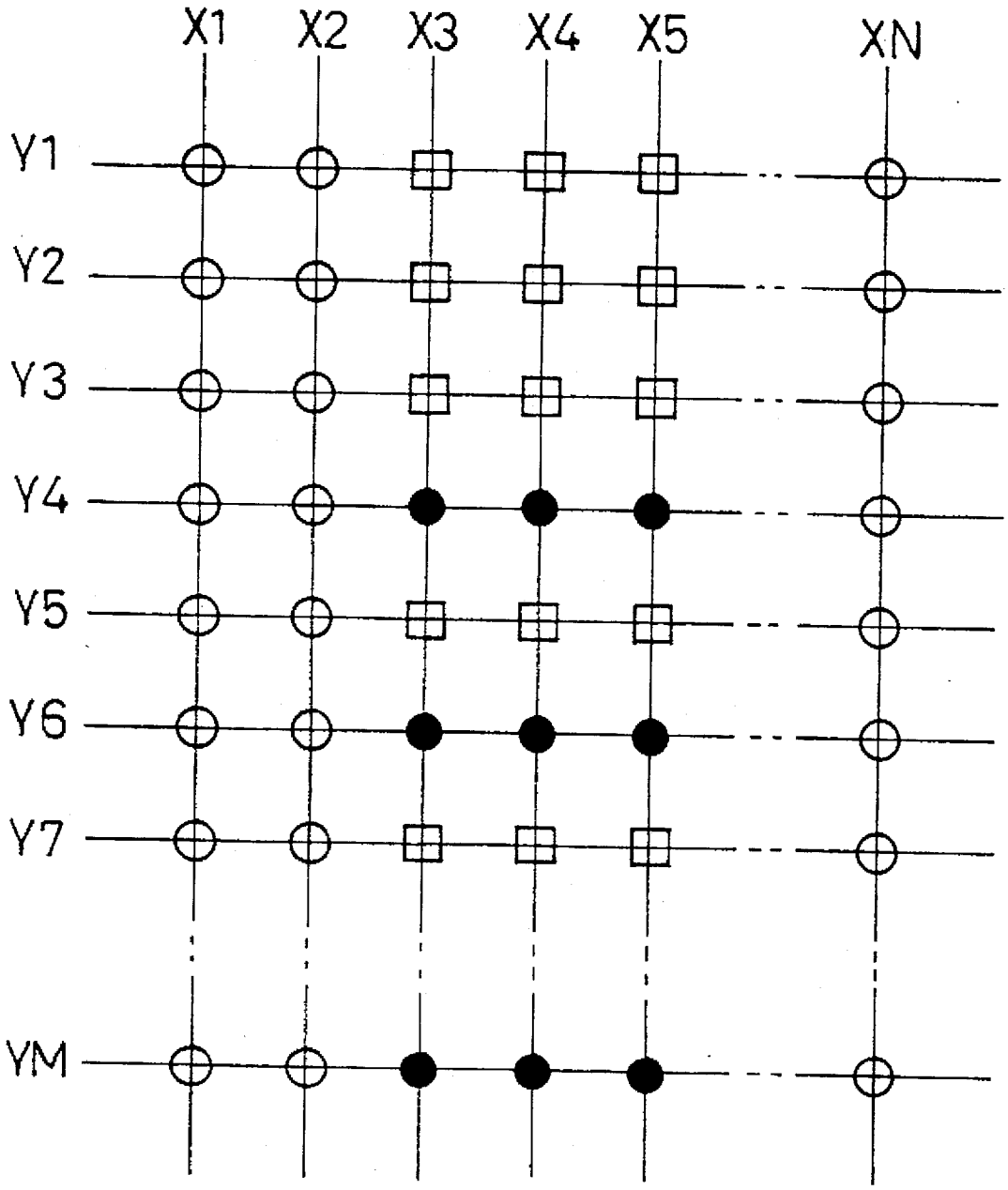
FIG. 10 is an explanatory drawing that indicates a case where a black pattern with lateral stripes is displayed in the white background on the liquid crystal display panel.
Figure 11A:
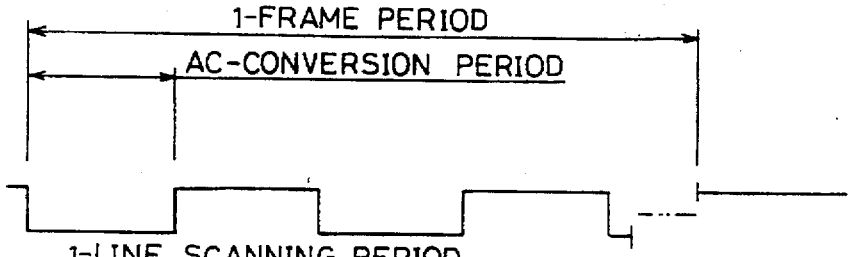
FIGS. 11(*a*) through 11(*e*) show optimal waveforms of signals to be applied to the liquid crystal display elements in the case of displaying the pattern of FIG. 10.
Figure 11B:
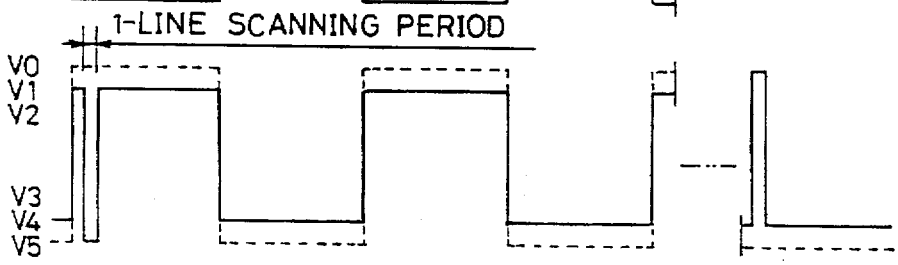
Figure 11C:
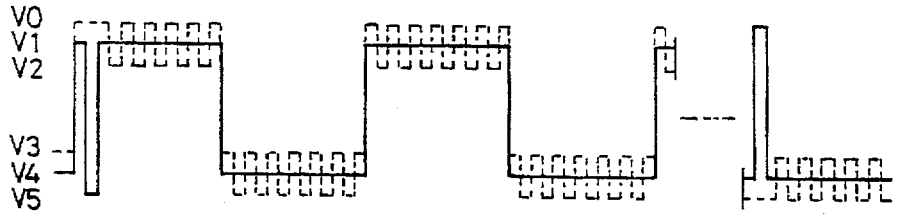
Figure 11D:
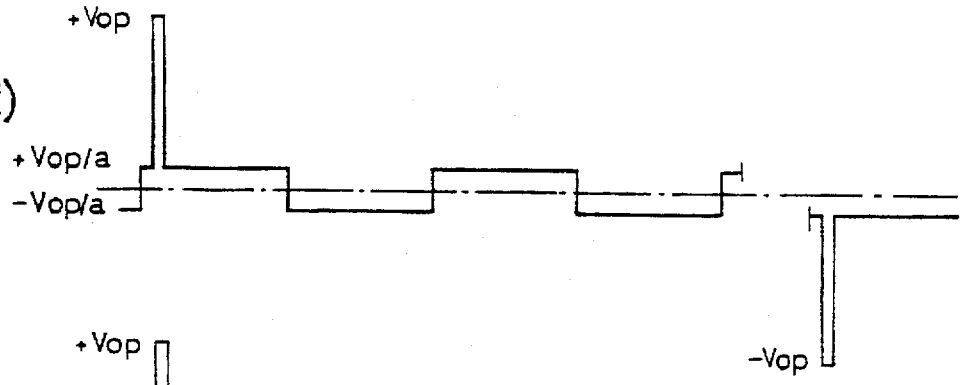
Figure 11E:
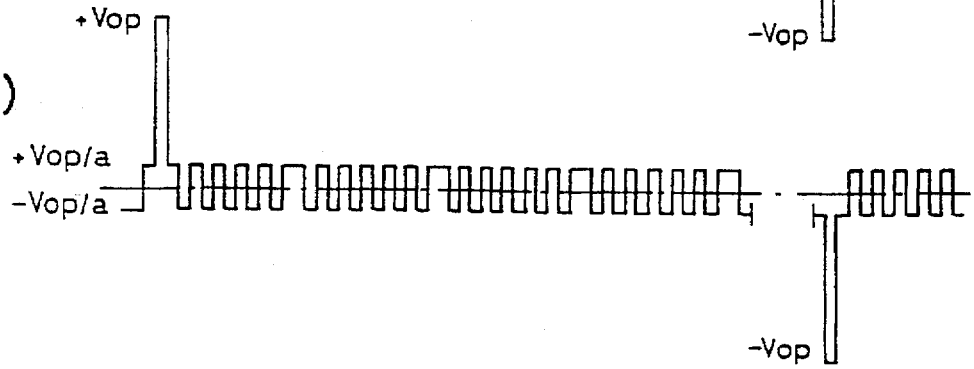
Figures 12A, 12B, 12C, 12D, 12E, 12F:
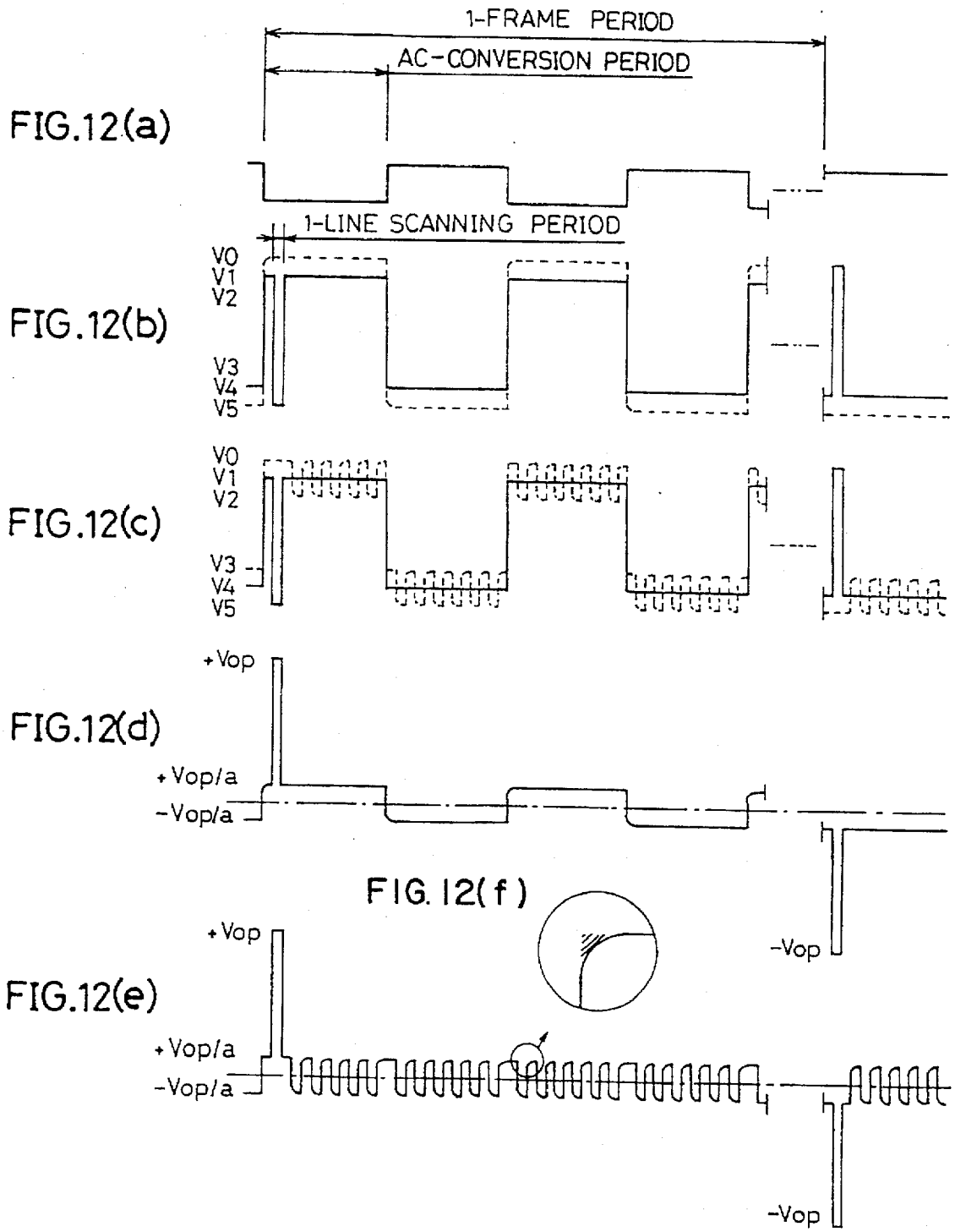
FIGS. 12(*a*) through 12(*f*) show actual waveforms of the signals to be applied to the liquid crystal display elements in the case of displaying the pattern of FIG. 10.
Figure 13:
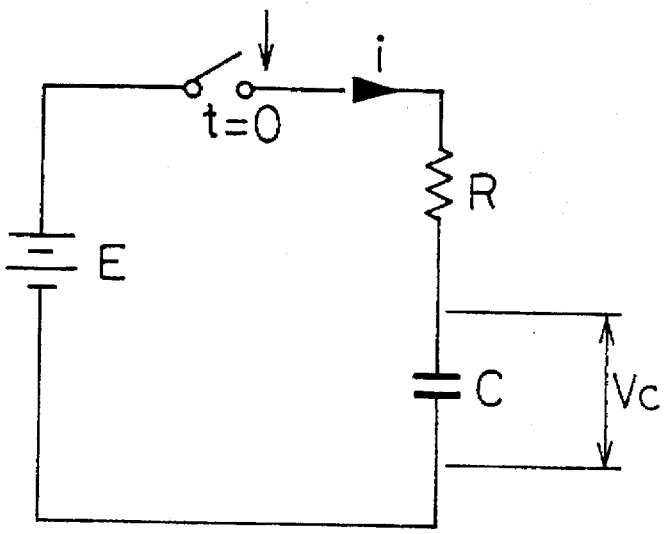
FIG. 13 shows an equivalent circuit of a circuit including the liquid crystal display elements.
Figure 14:
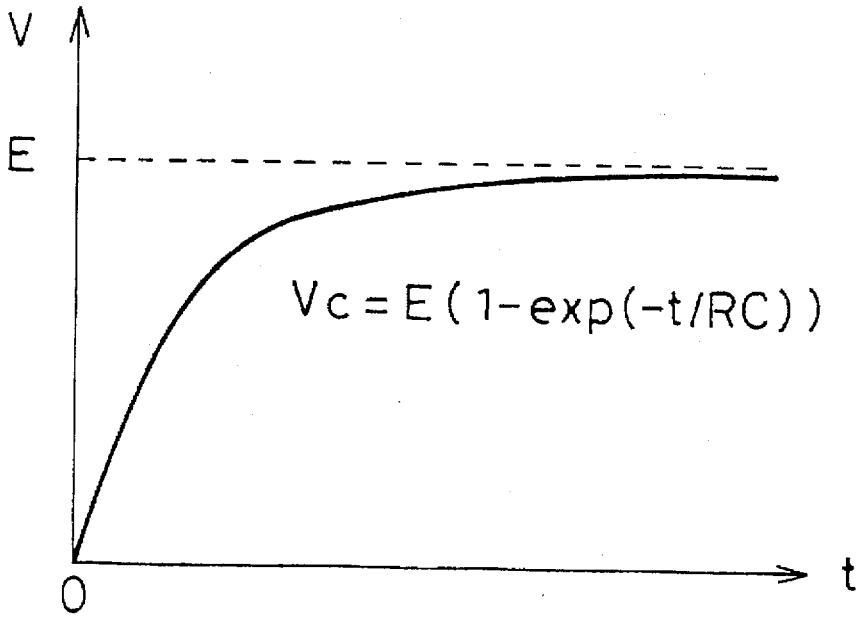

For example, FIG. 8(*b*) shows waveforms of voltages to be applied to the signal line X2 and the scanning line Y2, and FIG. 8(*c*) shows waveforms of voltages to be applied to the signal line X3 and the scanning line Y2. In this example, in the same manner as the prior art FIG. 10, the liquid crystal display elements 61 connected to the scanning lines Y4, Y6, Y8 . . . are displayed as black points except the liquid crystal display elements 61 that are connected to the signal lines X1 and X2, and the other liquid crystal display elements are displayed as white points.

In each drawing, the solid line shows a waveform of a voltage to be applied to the scanning line Y2, and the broken line shows a waveform of a voltage to be applied to the signal line X2 or X3.

Moreover, FIG. 8(*d*) shows a waveform of a driving voltage to be applied to the liquid crystal display element 61 that is connected to the signal line X2 and the scanning line Y2, and FIG. 8(*e*) shows a waveform of a driving voltage that is connected to the signal line X3 and the scanning line Y2.

In the present embodiment, no crosstalk is virtually observed not only in the case of displaying a black pattern of lateral stripes in the white background, but also in the case of displaying a white pattern of lateral stripes in the black background.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving device, which drives a display section that includes signal lines, scanning lines, and a plurality of liquid crystal display elements that are connected to the signal lines and the scanning lines and that are disposed in the form of matrix, comprising:

a scanning-line driver for releasing to the scanning lines a scanning signal for selecting the scanning lines successively;

a signal-line driver for releasing to the signal lines a display signal for displaying images in synchronism with the scanning signal;

a driving-voltage generation circuit for generating a plurality of voltages, having different voltage levels, used by the scanning-line driver to generate the scanning signal and used by the signal-line driver to generate the display signal; and a compensator which, during a compensating period that follows a display period during which display signals corresponding to one picture are transmitted to the signal lines, applies to each liquid crystal display element a compensating voltage that is proportional to the number of polarity inversions during the display period, and that is capable of cancelling a lowering in an effective value of a driving voltage for the liquid crystal display elements during the display period, the driving voltage being a difference in voltages between the levels of the display signal and the scanning signal, wherein the compensator further includes a compensation-number generation circuit and a plurality of switches, installed in the scanning-line driver and the signal-line driver, wherein the plurality of switches switch between voltages generated by the driving-voltage generation circuit based upon a number of compensations determined by the compensation-number generation circuit, and output resulting voltages.

2. The driving device as defined in claim 1, wherein the amplitude of the compensating voltage is constant and during the compensating period, the compensator applies the compensating voltage for a period that is proportional to the number of polarity inversions in the driving voltage.

3. A driving device which drives a display section that includes signal lines, scanning lines, and a plurality of liquid crystal display elements that are connected to the signal lines and the scanning lines and that are disposed in the form of matrix, comprising:

a scanning-line driver for releasing to the scanning lines a scanning signal for selecting the scanning lines successively;

a signal-line driver for releasing to the signal lines a display signal for displaying images in synchronism with the scanning signal;

a compensator which, during a compensating period that follows a display period during which display signals corresponding to one picture are transmitted to the signal lines, applies to each liquid crystal display element a compensating voltage that is proportional to the number of polarity inversions during the display period, and that is capable of cancelling a lowering in an effective value of a driving voltage for the liquid crystal display elements during the display period, the driving voltage being a difference in voltages between the levels of the display signal and the scanning signal, wherein the compensator applies the compensating voltage for a period that is equal to an 1-line scanning period with respect to each polarity inversion in the driving voltage.

4. The driving device as defined in claim 2, wherein the scanning lines and signal lines are ac-driven by the use of six voltages, V0 through V5, that satisfy the conditions, (V0–V1)=(V1–V2)=(V3–V4)=(V4–V5), and the amplitude of the compensating voltage is set to V0–V1.

5. A driving device, which drives a display section that includes signal lines, scanning lines, and a plurality of liquid crystal display elements that are connected to the signal lines and the scanning lines and that are disposed in the form of matrix, comprising:

a scanning-line driver for releasing to the scanning lines a scanning signal for selecting the scanning lines successively;

a signal-line driver for releasing to the signal lines a display signal for displaying images in synchronism with the scanning signal; and a compensator means which, during a compensating period that follows a display period during which display signals corresponding to one picture are transmitted to the signal lines, applies to each liquid crystal display element compensating pulses, the number of which is equal to the number of polarity inversions during the display period, which are capable of cancelling a lowering in an effective value of a driving voltage for the liquid crystal display elements during the display period, the driving voltage being a difference in voltages between the levels of the display signal and the scanning signal.

6. The driving device as defined in claim 5, wherein the pulse height and pulse width of the compensating pulse is determined so that the lowering in the effective value of the driving voltage, which is caused by each polarity inversion in the driving voltage, is cancelled.

7. The driving device as defined in claim 6, wherein the pulse width of the compensating pulse is set to be shorter than the display period.

8. The driving device as defined in claim 6, wherein the scanning lines and signal lines are ac-driven by the use of six voltages, V0 through V5, that satisfy the conditions, (V0–V1)=(V1–V2)=(V3–V4)=(V4–V5), as well as voltages, V1±Vs, where Vs, which corresponds to a pulse height of the compensating pulse, is set to satisfy 0<Vs<(V0–V1).

9. The driving device as defined in claim 8, wherein the polarity of the compensating pulse is inverted each time one picture is displayed.

10. The driving device as defined in claim 5, wherein the compensator is provided with a discriminator which discriminates whether or not display data on two consecutive scanning lines are different from each other, and wherein the compensating pulse is applied to liquid crystal display elements that are connected to the signal lines which display the different display data.

11. The driving device as defined in claim 10, wherein: the compensating period includes line-compensating periods the number of which is equal to the number of the scanning lines; the one-line compensating period is set to be shorter than the one-line scanning period; and the discriminator discriminates whether or not the compensating pulse should be applied for each line-compensating period.

12. The driving device as defined in claim 11, wherein the discriminator includes a latch circuit for storing display data corresponding to one line and an exclusive OR circuit for discriminating whether or not display data on two consecutive scanning lines are different from each other by finding an exclusive OR of the output data from the latch circuit and the display data.

* * * * *